United States Patent [19]

Dinger

[11] 4,417,554

[45] Nov. 29, 1983

[54] ELECTRONICALLY CONTROLLED FUEL INJECTION TIMER

[75] Inventor: Hans Dinger, Friedrichshafen, Fed. Rep. of Germany

[73] Assignee: Motoren-und Turbinen-Union Friedrichshafen GmbH, Friedrichshafen, Fed. Rep. of Germany

[21] Appl. No.: 340,216

[22] Filed: Jan. 18, 1982

[30] Foreign Application Priority Data

Jan. 16, 1981 [DE] Fed. Rep. of Germany ..... 3101167

[51] Int. Cl.[3] ..... F02M 59/20

[52] U.S. Cl. ..... 123/357; 123/501; 123/502

[58] Field of Search ..... 123/501, 502, 357, 494, 123/435

[56] References Cited

U.S. PATENT DOCUMENTS

| | | | |
|---|---|---|---|
| 2,270,410 | 1/1942 | Camner | 123/501 |
| 2,986,134 | 5/1961 | Bernard | 123/501 |
| 4,142,498 | 3/1979 | Hammond | 123/501 |
| 4,244,342 | 1/1981 | Fenne | 123/501 |
| 4,342,302 | 8/1982 | Strauber et al. | 123/502 |

FOREIGN PATENT DOCUMENTS

| | | | |
|---|---|---|---|
| 55-46073 | 3/1980 | Japan | 123/502 |
| 56-6030 | 1/1981 | Japan | 123/502 |

*Primary Examiner*—Ira S. Lazarus
*Assistant Examiner*—Magdalen Moy
*Attorney, Agent, or Firm*—Craig & Burns

[57] ABSTRACT

A fuel injection timer or regulator for a fuel injection pump is acted upon by a signal of an actual value generator detecting an actual injection time adjustment and by a signal of a desired value generator controlled by operating parameters of a piston internal combustion engine. At least one sensor is arranged at the piston internal combustion engine, with the sensor determining a rate of increase of the combustion pressure in the cylinder at each working stroke, and the desired value generator is controlled in dependence upon the output signal of the sensor.

10 Claims, 1 Drawing Figure

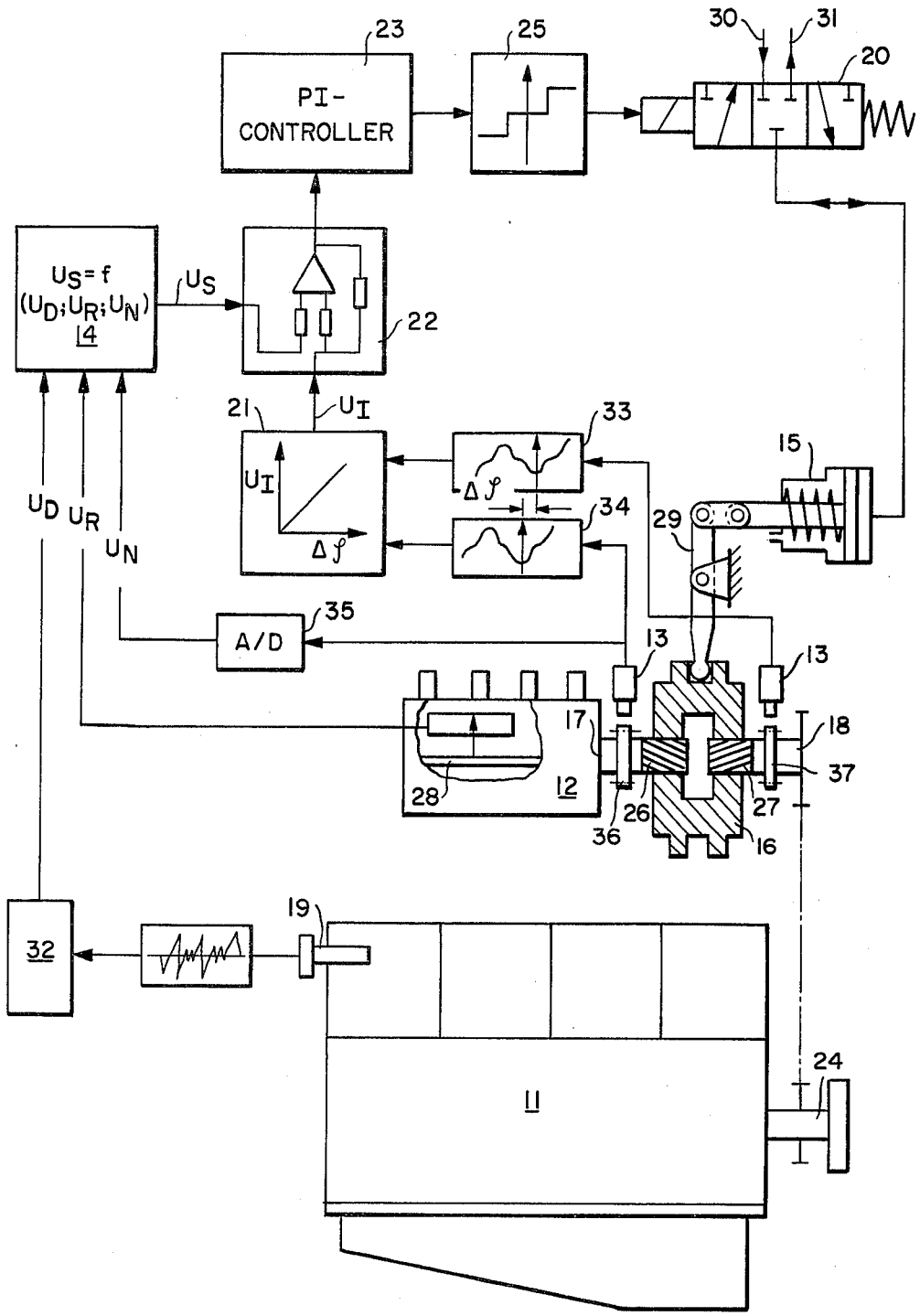
PI-
CONTROLLER
23
25
30
31
20
$U_S = f$
$(U_D; U_R; U_N)$
14
$U_S$
22
21
$U_I$
$U_I$
$\Delta\varphi$
33
34
15
29
$U_D$ $U_R$
$U_N$
A/D
35
13
13
17
18
37
28
12
26
27
36
16
32
19
11
24

ELECTRONICALLY CONTROLLED FUEL INJECTION TIMER

The present invention relates to a fuel injection arrangement and, more particularly, to an electronically controlled fuel injection timer for a fuel injection pump of a piston internal combustion engine, with the timer including an actual value sensor or detector for detecting an actual injection time adjustment and a desired value generator affected by operating parameters of the internal combustion engine.

A combustion process or operation preceding at a constant pressure in a cylinder of an internal combustion engine represents a theoretically ideal situation; however, such an ideal situation can be realized under practical conditions only to an incomplete extent. A measure for determining a quality of the combustion process is the rapidity of the pressure rise in the cylinder after an ignition of injected fuel has taken place. However, in the final analysis, the measures which have been taken for attempting to influence the combustion process have, for example, the objective of limiting the rate of pressure increase in the cylinder at the beginning of the combustion process to an optimum value.

A possibility for affecting the rate of pressure increase in a cylinder of an internal combustion engine resides in adjusting a beginning of a conveyance phase of a fuel injection pump of a beginning of the fuel injection.

The adjustment of the beginning of a conveying phase of a fuel injection pump may be accomplished by injection timers of the type disclosed, for example, in U.S. Pat. No. 2,861,557 and Auslegeschrift No. 2,337,622, with the timers being adapted to effect a change in a relative position between a crankshaft of the internal combustion engine and a cam shaft of the fuel injection pump.

An electronically controlled fuel injection device such as proposed in, for example, Auslegeschrift No. 2,337,622 and Offenlegungsschrift No. 2,932,672, wherein suitable sensors or detectors are disposed on the internal combustion engine for sensing or measuring various operation parameters of the engine. The measured or sensed parameters are fed to an electronic computer means which is adapted to determine, for a given field of characteristic curves, a desired value for control of the injection time, correlated with instantaneous operating conditions of the internal combustion engine. Fundamental input variables for the formation of the desired value include the rotational speed and load condition of the piston internal combustion engine.

One disadvantage of the above proposed electrically controlled fuel injection timers resides in the fact that a programming of the circuitry of the electronic computer means for forming the desired value requires a considerable expenditure in empirical work to determine the correlation between the measured operating parameters and the combustion process in the cylinders of the internal combustion engine. Although the measured operating parameters reflect the effects of the combustion process, they do not permit a direct evaluation of the rate or velocity of pressure increase.

The aim underlying the present invention essentially resides in providing an injection timer arrangement for a fuel injection means which optimizes the rate of pressure increase in a cylinder of the internal combustion engine at varying operating conditions by providing an improved desired value formation for controlling the injection timer.

In accordance with advantageous features of the present invention, a rate of combustion pressure increase in the cylinder of the internal combustion engine is determined with each working stroke by at least one sensor means arranged at the internal combustion engine, and a desired value generator is controlled in dependence upon an output signal of the sensor means.

Advantageously, in accordance with further features of the present invention, the sensor means responds directly to the combustion pressure ambient in the cylinder.

In accordance with further features of the present invention, the sensor is constructed for sensing or measuring a variable which may be measured with sufficient certainity or safety from an operating viewpoint and is proportional to a rate of pressure increase in the cylinders of the internal combustion engine.

The sensor may, for example, in accordance with the present invention, be responsive to a sonar wave triggered by the combustion process in the cylinder and be propogated in the cylinder crankcase.

Accordingly, it is an object of the present invention to provide an electronically controlled injection timer for a piston internal combustion engine which avoids, by simple means, shortcomings and disadvantages encountered in the prior art.

Another object of the present invention resides in providing an electronically controlled fuel injection timer for an internal combustion engine which is simple in construction and therefore relatively inexpensive to manufacture.

Yet another object of the present invention resides in providing an electronically controlled fuel injection timer for an internal combustion engine which optimizes the rate of pressure increase in a cylinder of the engine at varying operating conditions.

A still further object of the present invention resides in providing an electronically controlled injection timer for a fuel injection arrangement of an internal combustion engine which functions reliably under all load conditions of the engine.

Another object of the present invention resides in providing electronically controlled fuel injection timer with the effect of an adjusting motion of the injection timer on the rate of pressure increase being directly detected without detouring through operating variables or parameters which depend, only to a secondary degree, on the rate of pressure increase.

Yet another object of the present invention resides in providing an electronically controlled fuel injection timer for an internal combustion engine which enables, during operation of the internal combustion engine, with a fuel deviating from a standard or norm, the injection timing to automatically adjust itself to values optimum for the respective fuel.

These and other object, features and advantages of the present invention will become more apparent from the following description when taken in connection with the accompanying drawing which shows, for the purpose of illustration only, one embodiment in accordance with the present invention, and wherein:

The single FIGURE of the drawing is a partially schematic view of an electronically controlled timer for a fuel injection device for an internal combustion engine constructed in accordance with the present invention.

Before describing, in detail, the particular improved electronically controlled timer or regulator for a fuel injection device of an internal combustion engine, it should be observed that the present invention resides primarily in a novel structural combination of previously proposed components and not in the particular detailed configurations thereof. Accordingly, the structure, control, and arrangement of these components and circuits, for the most part, have been illustrated in the drawing by a readily understandable block representation and schematic diagram, which show only the specific details that are pertinent to the present invention, in order not to obscure the disclosure with structural details which will be readily apparent to those skilled in the art having benefit of the description herein. Thus, the block diagram illustration of the single FIGURE of the drawing does not necessarily represent the mechanical structural arrangement of an exemplary system, but is primarily intended to illustrate the major structural components of the system in a convenient functional grouping, whereby the present invention can be more readily understood.

Referring now to the single FIGURE of the drawing, according to this FIGURE, an electronically controlled fuel injection timer or regulator for a fuel injection pump 12 of a piston internal combustion engine 11 includes a sensor or detector means 13 for detecting an operating parameter such as, for example, the rotational speed of the internal combustion engine and for transmitting an output signal representing an actual rotational speed through an analog to digital converter means 35 to a desired value adjustment or computing circuit means 14, of conventional construction. The adjustment of computing circuit means 14 provides an output control or desired value signal $U_S$ to a comparator circuit means 22. A hydraulic regulating drive means or servo drive mechanism is provided for an injection setting or adjusting device 16, with the adjusting device 16 being axially displacable by a lever 29 and meshing with oppositely obliquely grooved ends 26, 27 of two drive parts 17, 18 of a drive shaft of a fuel injection pump 12. A shifting of the adjusting elements 16 effects a change in the relative position of the drive part or section 17 with respect to the drive part or section 18 and/or with respect to a crankshaft 24 of the internal combustion engine 11 whereby an onset or initiation of feeding of the fuel injection pump 12 and, consequently, the instant of fuel injection in the cylinders of the internal combustion engine 11 is altered.

Sensors 13 may, for example, be inductive sensors and are adapted to sense or detect a relative position of the drive part or section 17 with respect to the drive part of section 18. Each of the sensors 13 produce, in cooperation with a revolving gear wheel 36, 37, respectively mounted on the drive parts or sections 17, 18, an alternating voltage 33 or 34, a phase shift $\Delta\zeta$ of which is transformed, in an actual value generating circuit 21, to a DC voltage signal, $U_I$ as the actual value signal. The actual value signal is compared in a comparator circuit means 22 with the desired value signal $U_S$ supplied by the desired value computing circuit means 14.

A sensor or detector means 19, of conventional construction, is disposed on the internal combustion engine, with the sensor means sensing the combustion process. The sensor or detector means 19 is responsive to a rate of increase or rise of combustion pressure in the cylinders and provides an output control signal to a filter network means 32. In the filter network means 32, a useful signal is obtained from the output control signal of the sensor means 19. The useful signal is in the form of an alternating voltage consisting of a frequency mixture and is transformed by the filter network means 32 to a rate of pressure increase signal $U_D$ supplied to the desired value of adjustment or computing circuit means 14 so as to enable the adjustment or computing circuit means to be influenced by operating parameters or magnitudes of the internal combustion engine.

The sensor or detector means 19 may be responsive to sonar waves which are triggered by the combustion process in the cylinder and propogate through th cylinder crankcase or the sensor means 19 may be responsive to a rotational oscillation of the crankshaft, which oscillation is triggered by the combustion process in the cylinders of the engine 11. The sensor means 19 may, for example, be constructed as a solid-borne microfilm.

For a formation of the desired value, the number of revolutions and the load on the piston internal combustion engine 11, as well as the quality of the combustion process in the cylinder are governing. A measure for the load on the piston internal combustion engine 11 is the amount of fuel injected and, for example, the load may be measured by determining, for example, a position of a control rod 28 of the fuel injection pump 12. The control rod position may, for example, be derived in the form of a voltage from a potentiometer having a wiper which moves with the control rod 28, with the voltage being feed, as a control rod position signal $U_R$ to the adjustment or computing circuit means 14. The alternating voltage produced by one of the sensor means 13 may be an indicator of the number of revolutions of the piston internal combustion engine 11, with the voltage being transformed by the analog-to-digital converter 35 into the rotational speed signal $U_N$. The quality of the combustion process may, as noted above, be detected by the sensor means 19 which is responsive to the rate of pressure increase and the cylinder.

The adjustment or computing circuit means 14 produces, in a programmable dependency, the desired value signal $U_S$, wherein $U_S = f(U_D, U_R, U_N)$ for the comparator circuit means 22 from the rate of pressure increase signal $U_D$, the control rod position signal $U_R$, and the speed signal $U_N$. The output signal of the comparator circuit means 22 is an interference variable for a subsequently connected PI or proportional-integral controller 23. The controller 23 provides an output control signal 25 corresponding to the interference variable to an electromagnetic control valve 20. Depending upon the direction in which the adjusting element 16 must be displaced, the pressure chamber of the hydraulic regulating drive 15 is connected through the electromagnetic control valve 20 with a pressure line 30 or a relief line 31.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. An electronically controlled fuel injection timer means for a fuel injection pump of a piston internal combustion engine, the timer means includes control means for controlling an instant of fuel injection, means for generating a desired value of an injection setting in dependence upon operating parameters of the engine, and for providing a control signal to the control means, characterized in that at least one sensor means is provided for sensing a measurable operating parameter relating to the combustion pressure for a working stroke of the engine and for providing an output control signal to the means for generating a desired value, whereby the generating means is controlled in dependence upon the output control signal of the at least one sensor means, and in that the operating parameter is proportional to a rate of increase in combustion pressure in a cylinder of the engine.

2. An electronically controlled fuel injection timer means for a fuel injection pump of a piston internal combustion engine, the timer means includes a control means for controlling an instant of fuel injection, means for generating a desired value of an injection setting in dependence upon operating parameters of the engine, and for providing a control signal to the control means, at least one sensor means is provided for sensing a measurable operating parameter relating to a combustion pressure for each working stroke of the engine and for providing an output control signal to the means for generating a desired value, whereby the generating means is controlled in dependence upon the output control signal of the at least one sensor means, and characterized in that the operating parameter is a sonar wave triggered by the combustion pressure in a cylinder of the engine, and in that the at least one sensor means is responsive to the sonar wave propogating in a cylinder crankcase of the engine.

3. An electronically controlled fuel injection timer means for a fuel injection pump of a piston internal combustion engine, the timer means includes control means for controlling an instant of fuel injection, means for generating a desired value of an injection setting in dependence upon operating parameters of the engine, and for providing a control signal to the control means, at least one sensor means is provided for sensing a measurable operating parameter relating to a combustion process for each working stroke of the engine and for providing an output control signal to the means for generating a desired value, whereby the generating means is controlled in dependence upon the output control signal of the at least one sensor means, characterized in that the operating parameter is rotational oscillation of a crankshaft of the engine triggered by the combustion process, in a cylinder of the engine, and in that the at least one sensor means is responsive to the rotational oscillation.

4. An electronically controlled fuel injection timer means for a fuel injection pump of a piston internal combustion engine, the timer means includes control means for controlling an instant of fuel injection, means for generating a desired value of an injection setting in dependence upon operating parameters of the engine, and for providing a control signal to the control means, at least one sensor means is provided for sensing a measurable operating parameter relating to a combustion process for each working stroke of the engine and for providing an output control signal to the means for generating a desired value, whereby the generating means is controlled in dependence upon the output control signal of the at least one sensor means, characterized in that the operating parameter is combustion pressure, and in that the at least one sensor means is adapted to sense a rate of increase in the combustion pressure in a cylinder of the engine.

5. An electronically controlled fuel injection timer means for a fuel injection pump of a piston internal combustion engine, the timer means includes control means for controlling an instant of fuel injection, means for generating a desired value of an injection setting in dependence upon operating parameters of the engine, and for providing a control signal to the control means, at least one sensor means is provided for sensing a measurable operating parameter relating to a combustion process for each working stroke of the engine and for providing an output control signal to the means for generating a desired value, whereby the generating means is controlled in dependence upon the output control signal of the at least one sensor means, at least two sensor means are provided for respectively sensing a measurable operating parameter relating to the combustion process and for providing an upper controll signal to the means for generating a desired value, characterized in that the measurable operating parameter of the first of the at least two sensor means is a rate of increase of the combustion process in a cylinder of the engine, and in that the measurable operating parameter of the second of the at least two sensor means is a rotational speed of the engine.

6. An electronically controlled fuel injection timer means according to claim 5, characterized in that means are provided for measuring a load on the engine and for providing an output load signal to the means for generating the desired value.

7. An electronically controlled fuel injection timer means according to claim 6, characterized in that the first of the two sensor means includes a first and second sensor element for sensing the rotational speed of the first and second sections of the drive shaft of the fuel injection pump, an analog digital converter means is interposed between one of the first and second sensor elements and the means for generating the desired value, means are provided for supplying an output signal of said one of said first and second sensor elements to said means for supplying the desired value from the means for generating the desired value to the control element.

8. An electronically controlled fuel injection timer means according to claim 7, characterized in that the drive means includes a hydraulic servo mechanism, the drive control means includes an electromagnetic valve means for controlling a supply of hydraulic fluid to the hydraulic servo mechanism, a control element includes a proportional-integral controller, and in that the means for supplying the desired value to the control element includes a comparator circuit means for comparing the desired value with an actual value of the operating parameter.

9. An electronically controlled fuel injection timer means according to claim 8, characterized in that said means for supplying an output signal of said one of the first and second sensor elements to said means for supplying the desired value includes an actual-value generating circuit means.

10. An electronically controlled fuel injection timer means according to claim 9, characterized in that an output signal of the other of the first and second sensor elements is supplied to the actual-value-generating circuit means.

* * * * *